US005201432A

United States Patent [19]

Elvin-Jensen

[11] Patent Number: 5,201,432

[45] Date of Patent: Apr. 13, 1993

[54] CONTAINERS

[76] Inventor: Flemming Elvin-Jensen, 4655 Wiidgreen Drive, West Vancouver, British Columbia, Canada, V7S 2V4

[21] Appl. No.: 771,142

[22] Filed: Oct. 3, 1991

[30] Foreign Application Priority Data

Oct. 10, 1990 [AU] Australia ..... 63937/90

[51] Int. Cl.[5] ..... B65D 5/00

[52] U.S. Cl. ..... 220/1.5; 220/445; 220/4.13

[58] Field of Search ..... 220/445, 469, 1.5, 410, 220/407, 669, 4.13; 229/3.5 R

[56] References Cited

U.S. PATENT DOCUMENTS

| | | | |
|---|---|---|---|
| 3,246,789 | 4/1966 | Progler | 220/445 X |
| 3,274,315 | 9/1966 | Kawamura | 229/3.5 R X |
| 3,509,005 | 4/1970 | Hartig | 229/3.5 R |
| 3,907,147 | 9/1975 | Goobeck | 220/1.5 |
| 4,280,640 | 7/1981 | Daloisio | 220/1.5 X |
| 4,375,265 | 3/1983 | van de Wetering et al. | 220/1.5 |
| 4,782,973 | 11/1988 | Wiese | 220/1.5 X |
| 4,887,731 | 12/1989 | Pett et al. | 220/1.5 |
| 4,936,615 | 6/1990 | Moore | 220/1.5 X |
| 4,948,039 | 8/1990 | Amatangelo | 220/445 X |

FOREIGN PATENT DOCUMENTS

3500427A1 10/1986 Fed. Rep. of Germany .

*Primary Examiner*—Steven M. Pollard
*Attorney, Agent, or Firm*—Bell, Seltzer, Park & Gibson

[57] ABSTRACT

The invention provides a plastic container for holding liquid having a base, a pair of side walls, and a pair of end walls. The container is formed as an injection molding and the pairs of side walls and pairs of end walls each have a reinforced double wall construction including integral cross pieces extending vertically in the direction of mold movement. The liquid container is capable of holding 200 liters or more of liquid.

28 Claims, 2 Drawing Sheets

CONTAINERS

This invention relates to plastic containers.

According to one aspect of the invention there is provided a plastics container comprising a base wall, a pair of side walls and a pair of end walls, wherein the walls of at least one of the said pairs of walls comprise a pair of parallel surfaces connected together and re-inforced a pair of parallel surfaces connected together and re-in-forced by cross pieces. The container is preferably an injection moulding and the cross-pieces extend in the direction of mould movement. Thus a wall is provided which is reinforced by projections but is unencumbered by re-inforcing on both on its interior and exterior surfaces which are preferably entirely smooth. Preferably at least one of the remaining walls is reinforced but does not comprise parallel surfaces, this said wall preferably being the base wall. Preferably the side and end walls comprise parallel surfaces joined together by cross-pieces as aforedescribed. Insulation material may be inserted between the surfaces of the multi-surface walls.

One of the pairs of side and end walls preferably extends below the base wall to leave a gap below the base wall, into which gap the forks of a fork lift truck can be inserted to permit the container to be carried thereby. The walls of the other pair of walls preferably taper at the entrance to the gap to provide a lead-in surface for the forks. A high wear resistant high density polyethylene plate is preferably provided at such tapered portion to protect it. The extensions may conveniently be formed separately and inserted between the surfaces.

The container is conveniently provided with a lid. This lid preferably has an interior rim which fits within the side and end walls. The inner surface of the rim is preferably radiussed to provide a rounded corner for ease of cleaning. The lid is preferably a double surface wall which is closed at its edges and which has cross-ribs extending between the surfaces. These surfaces are preferably separately formed by injection moulding and then by heating the ends of the cross-ribs and edges softening these and forcing the surfaces together so that the ribs seal. The lid is preferably welded to the end and side walls of the container.

The lid conveniently has an enlarged opening therein. An inlet feed member is preferably received into the opening preferably by being screw threaded therein. The feed member preferably has a filling opening with a filling plug closing this opening. A vent valve may also be provided in the feed member. The size of the opening is preferably such that there is access to the interior of the container for cleaning purposes.

At the upper side of its corners, the lid may be provided with frusto-conical projections to provide locating means for a second container placed thereon. The projections are preferably internally cored to receive an eye which may be engaged by a hook for lifting purposes. Below the projections, the lid may have locating means that engage in recesses in the walls.

The base of the container is preferably provided with an outlet opening which is preferably located near to one of the other walls and the base wall preferably slopes towards the outer opening. Within the opening there may be received the inlet member of an angled elbow connection to permit liquid contents of the container to be delivered outside the envelope of the container.

An embodiment of the invention will now be described by way of example with reference to the accompanying drawings.

Figure 1:
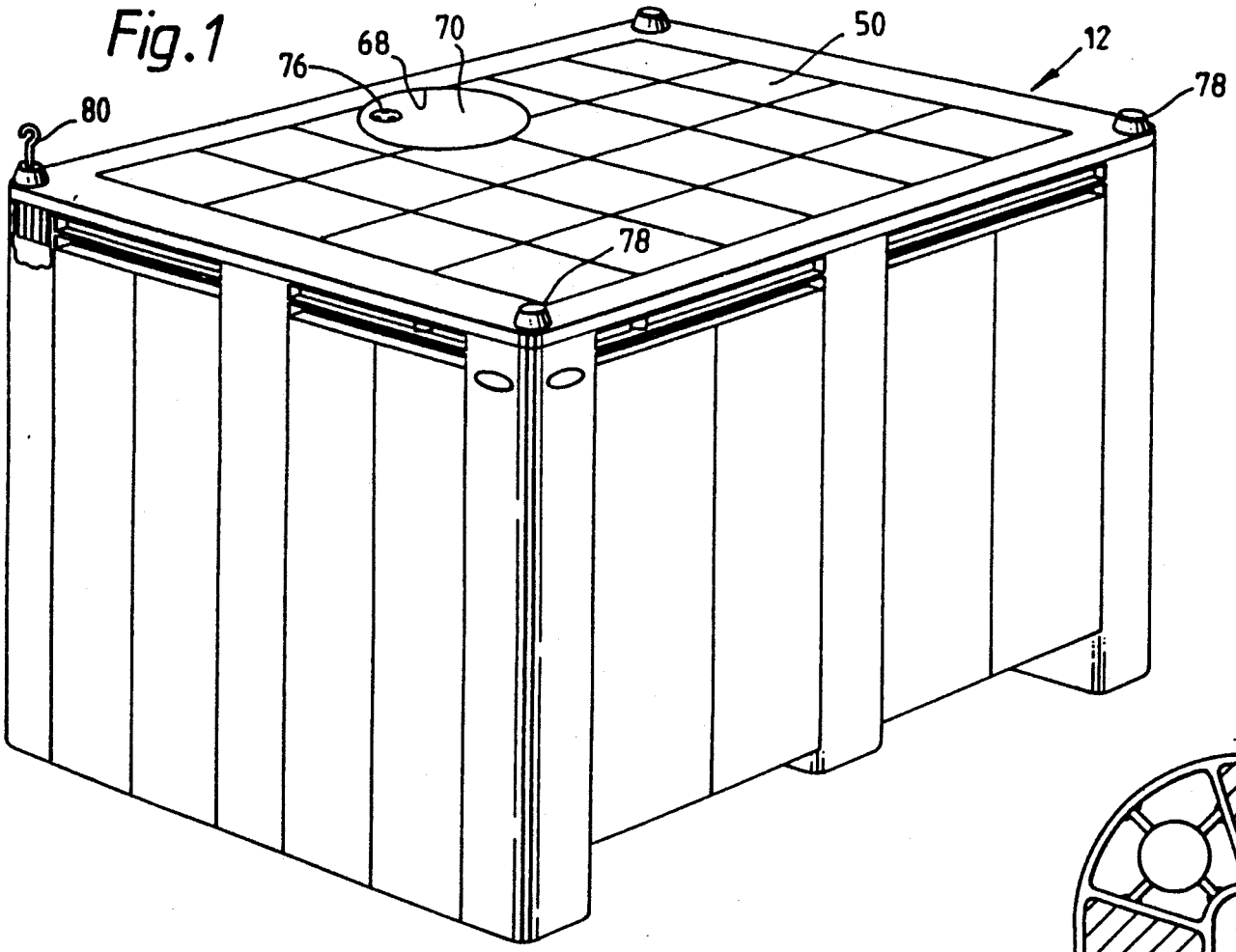
FIG. 1 is an outside view of a container of the invention.

Referring now to the drawings, there is shown a container 10 of the invention. The container is formed as a plastics injection moulding. The container 10 which is parallelipipedal in shape comprises a body 12 and a lid (described below). The body 12 comprises a base wall 16, a pair of opposite side walls 18 and a pair of opposite end walls 20.

The side and end walls 18 and 20 are each comprised by a pair of spaced parallel surface members 22 and 24 which are connected together by cross-pieces 26 and which are open at their lower ends. The cross-pieces 26 extend vertically from the base wall 16, i.e. in the direction of mould movement during the moulding of the container. Thus the side and end walls are of double wall construction reinforced by the cross-pieces 26. Furthermore the interior and exterior surfaces of each of the double walls is smooth. The base wall 16 is also re-inforced by projection walls **16*a*** arranged in a mesh-like formation as is known in the art.

At their junctions, the side and end walls and the base walls are heavily radiused for ease of cleaning.

The base wall 16 has an outlet opening 28 which is located near to one side 18 about midway between the end walls 20. The base wall 16 slopes towards this outlet opening 28. A plug 29 normally closes this opening 28.

An angled elbow connection 30 (shown in chain lines) may be inserted into the opening 28 for delivering the contents of the container is provided. The connection 30 has a vertical inlet member 31 that is received within the outlet opening 28, a long delivery arm 32 including a closure cock 34, and a delivery spout 36. The connection 30 can thus permit liquid contents of the container to be delivered outside the envelope of the container. (Although the connection 30 is shown projecting inwardly of the container, it can be, and usually is arranged projecting outwardly.)

At their lower ends, the end walls 20 receive rigid feet 38 on which the container rests to leave a gap 40 below the base wall 16. Each foot 38 comprises an upstanding leg 42 that fits between the lower portion of the surface members 22 and 24 and has at locations along its length a pair of projections which fit into corresponding openings in the outer surface members 22. Thus each foot 38 is firmly held in position. Each foot 38 also has a pair of openings 44 to receive the forks of a forklift truck under certain circumstances which will be discussed below.

At the entrance to the gap 40, the projection walls **16*a* on the base wall 16 are of decreasing length. There is thus formed a lead-in portion 46, which is up to 50% larger than the remainder of the gap 40, to serve to facilitate and guide the entry of the forks into the gap 40. A high-wear-resistant polypropalene plate 48 is provided at such lead-in portion to protect it. The plate 48 has projections on its upper surface that fit firmly in between the projection walls of the base wall thereby holding the plate 48** firmly in position.

The upper end of the container 10 is closed by a lid 50 which is welded to the end and side walls of the container. The lid 50 has a pair of surface walls 52 and 54 which are closed at their edges 54 and which have cross-ribs 58 extending therebetween. These surfaces 52 and 54 are separately formed by injection moulding each to have portions of the cross-ribs 58 integral with it. After the surfaces 52 and 54 are thus formed, the ends of the cross-ribs 58 and the edges 60 are heated to soften them. The surfaces 52 and 54 are then forced together so that the ends of the ribs 58 and edges 54 seal with one another to form an integral unit.

On its underside, the lid 50 has a peripheral recess 64 so that the lid body fits closely within the side and end walls 18 and 20. The inner surface 66 of the rim 64 is heavily radiused to provide a rounded corner for ease of cleaning.

The lid 50 has an enlarged aperture 68 therein. The size of the opening is preferably such that there is access to the interior of the container for cleaning purposes. A closure member 70 is threadedly received into the aperture 68. The inlet member 70 incorporates a filling opening 72 with a filling plug 74 threadedly received therein to close this opening 72. A vent valve 76 is also provided in the closure member 70.

At the upper side of its corners, the lid 50 has low wide frusto-conical projections 78. A bore (not shown) is formed in each such projection 78 to receive a lifting eye 80 which may be engaged by a hook for lifting purposes. Below the projections 78, the lid 50 has a recess which engages on a projection at junctions between the side and end walls for additional locating of the lid on the container.

The container can be easily lifted by a fork-lift truck with the forks passing through the openings in the feet. If it is desired to tip the container for any purpose, the forks can be passed through the openings 44 in the feet 38 so that there is a firm connection therebetween.

Figure 4:
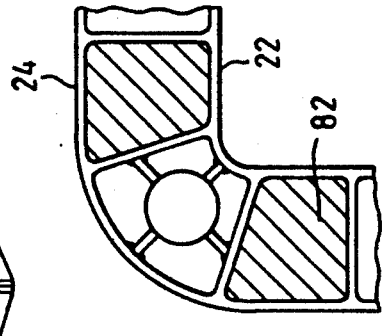
FIG. 4 is a detail section on line 4—4 of FIG. 1.
Figure 3:
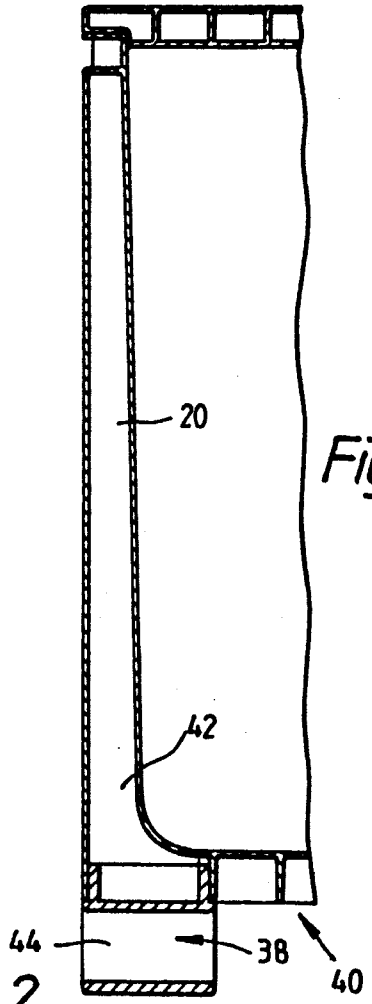
FIG. 3 is a detail section through the feet of the container.
Figure 2:
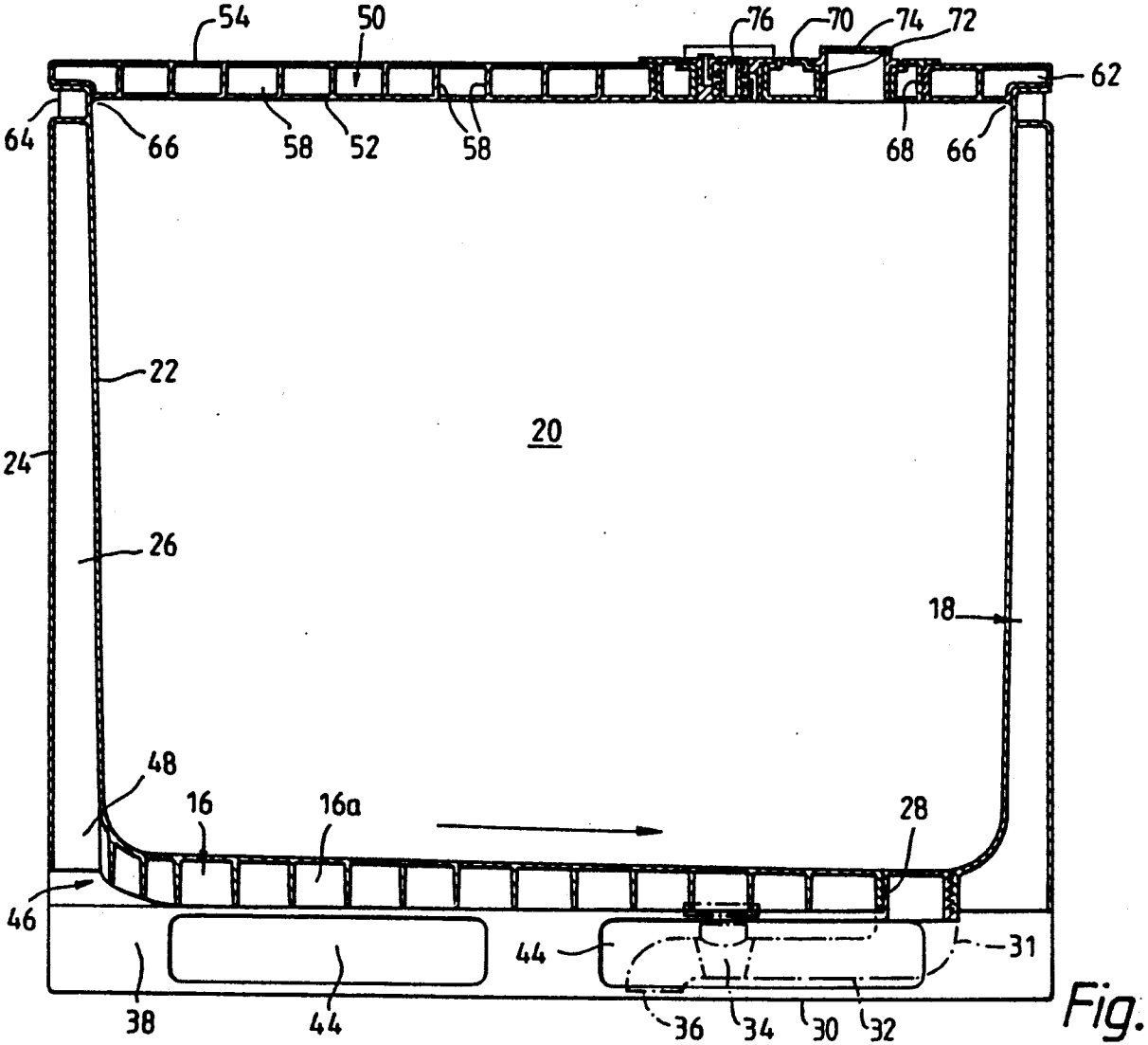
FIG. 2 is a transverse section through the container.

The container 10 as above described may be of any convenient size which may range from two hundred liters to fifteen hundred liters. Because of the double surface construction, the side and end walls will be rigid and will not bulge when the container is filled with liquid. Furthermore, a degree of insulation is achieved with the air gap and may be supplemented by inserting between the walls foam or other insulating material (indicated at 82 in FIG. 4). Because of its cuboidal form, the container provides a very efficient containment for liquids.

The invention is not limited to the precise constructional details hereinbefore described and illustrated in the drawings.

It is to be noted that in this specification the term "parallel" is used in to include in its meaning "near parallel" as many parts have a small taper (normally of the order of 4°) to facilitate demoulding.

I claim:

1. A plastics container adapted for holding liquid comprising a base wall, a pair of sidewalls and a pair of end walls, said base wall, sidewalls and endwalls having been integrally formed as an injection molding, wherein said pairs of side walls and said pairs of end walls each have a reinforced double wall construction comprising a pair of parallel surfaces connected together and reinforced by integral cross pieces, said cross pieces extending vertically in the direction of mold movement, said container being of a size for holding at least about 200 liters.

2. A container as claimed in claim 1 wherein each reinforced walls are unencumbered by re-inforcing on both on its interior and exterior surfaces.

3. A container as claimed in claim 2 wherein the interior and exterior surfaces of the wall are preferably entirely smooth.

4. A container as claimed in claim 2 wherein the lid is provided at the upper side of its corners with frusto-conical projections to provide locating means for a second container placed thereon.

5. A container as claimed in claim 4 wherein each projections is internally cored to receive an eye which may be engaged by a hook for lifting purposes.

6. A container as claimed in claim 5 wherein below the projections, the lid has locating means that engage on projections on four corners where the walls meet.

7. A container as claimed in claim 1 wherein said base wall is reinforced but does not comprise parallel surfaces.

8. A container as claimed in claim 1 wherein insulation material is inserted between the surfaces of the multi-surface walls.

9. A container as claimed in claim 1 wherein one of the pairs of side and end walls has extensions extending below the base wall to provide a support for the container in such a way as to leave a gap below the base wall, into which gap the forks of a fork lift truck can be inserted to permit the container to be carried thereby.

10. A container as claimed in claim 9 wherein the walls of the other pair of walls taper at the entrance to the gap to provide a lead-in surface for the forks.

11. A container as claimed in claim 9 wherein the walls of the other pair of walls taper at the entrance to said gap to provide a lead-in surface for the forks, and wherein a wear resistant high density polyethylene plate which is separate from the side walls is provide at said lead-in surface to protect it.

12. A container as claimed in claim 9 wherein the outer wall of the said other pair of walls stop short of the bottom of the base thus allowing an angle plate to be inserted thereby increasing the fork lift entry gap without reducing the internal volume of the container.

13. A container as claimed in claim 1 provided with a lid.

14. A container as claimed in claim 13 wherein the lid has an interior rim which fits within the side and end walls.

15. A container as claimed in claim 14 wherein the inner surface of the rim is radiussed to provide a rounded corner for ease of cleaning.

16. A container as claimed in claim 14 wherein the lid comprises a double surface wall which is closed at its edges and which has cross-ribs extending between the surfaces.

17. A container as claimed im claim 16 wherein said surfaces of the lid are separately formed by injection moulding and then by heating the ends of the cross-ribs and edges to soften these and forcing the surfaces together so that the ribs seal.

18. A container as claimed in claim 17 wherein the ribs are provided on one surface only of the lid and are thus welded directly to the other surface.

19. A container as claimed in claim 18 wherein the lid is welded to the end and side walls of the container.

20. A container as claimed in claim 13 wherein the lid has an enlarged aperture therein.

21. A container as claimed in claim 20 wherein an inlet feed member is received into the aperture, being screw threaded therein.

22. A container as claimed in claim 21 wherein the feed member has a filling opening with a filling plug closing this opening.

23. A container as claimed in claim 21 wherein a vent valve is provided in the feed member.

24. A container as claimed in claim 20 wherein the size of the aperture is such that there is access to the interior of the container for cleaning purposes.

25. A container as claimed in claim 1 wherein the base of the container is provided with an outlet opening.

26. A container as claimed in claim 1 wherein said base wall of the container is provided with an outlet opening located near to one of said other walls.

27. A container as claimed in claim 26 wherein the base wall slopes towards the outlet opening.

28. A container which, as claimed in claim 1, when filled with more than 50 gallons of liquid is so rigid that it does not bulge or need reinforcing, because of its double wall design.

* * * * *

UNITED STATES PATENT AND TRADEMARK OFFICE

CERTIFICATE OF CORRECTION

PATENT NO. : 5,201,432

DATED : April 13, 1993

INVENTOR(S) : Flemming Elvin-Jensen

It is certified that error appears in the above-indentified patent and that said Letters Patent is hereby corrected as shown below:

Col. 1, lines 10-11, please delete "a pair of parallel surfaces connected together and re-in-forced".

In the Claims:

Column 4, line 37,
In Claim 11, line 5, please delete "provide" and insert -- provided --.
Column 4, line 56,
In Claim 17, line 1, please delete "im" and insert -- in --.

Signed and Sealed this

Sixth Day of June, 1995

*Attest:*

*Attesting Officer*

BRUCE LEHMAN

*Commissioner of Patents and Trademarks*